US007781655B2

(12) United States Patent
Vosough et al.

(10) Patent No.: US 7,781,655 B2
(45) Date of Patent: Aug. 24, 2010

(54) STRING FOR MUSICAL INSTRUMENT

(75) Inventors: Sina Vosough, Sandviken (SE); Anders Söderman, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/085,031

(22) PCT Filed: Nov. 15, 2006

(86) PCT No.: PCT/SE2006/050476

§ 371 (c)(1),
(2), (4) Date: May 12, 2009

(87) PCT Pub. No.: WO2007/058611

PCT Pub. Date: May 24, 2007

(65) Prior Publication Data

US 2009/0217795 A1 Sep. 3, 2009

(30) Foreign Application Priority Data

Nov. 16, 2005 (SE) ..... 0502528

(51) Int. Cl.
*G10D 3/10* (2006.01)

(52) U.S. Cl. ..... 84/297 S; 84/199

(58) Field of Classification Search ..... 84/199, 84/297 S

See application file for complete search history.

(56) References Cited

U.S. PATENT DOCUMENTS 26,304 A * 11/1859 Thompson ..... 84/297 S
202,020 A * 4/1878 Gray ..... 84/199
303,651 A * 8/1884 Ludwid ..... 84/199
740,918 A * 10/1903 Ramacciotti ..... 84/199
1,383,174 A * 6/1921 Udy et al. ..... 428/657
2,252,095 A 8/1941 Pavek
3,605,544 A * 9/1971 Kondo ..... 84/199
3,753,797 A * 8/1973 Fukuda ..... 148/576
4,063,674 A * 12/1977 Stone et al. ..... 228/173.5
4,333,379 A * 6/1982 Meinel et al. ..... 84/297 S
4,715,908 A * 12/1987 Churchill ..... 148/327
4,765,953 A * 8/1988 Hagenfeldt et al. ..... 420/65
5,298,093 A * 3/1994 Okamoto ..... 148/325
5,672,315 A * 9/1997 Okato et al. ..... 420/40
5,716,466 A * 2/1998 Yamaoka et al. ..... 148/325

(Continued)

FOREIGN PATENT DOCUMENTS

JP 71000934 B * 5/1967

(Continued)

OTHER PUBLICATIONS

Stainless Steel, Wikipedia, viewed Oct. 14, 2009.*

(Continued)

*Primary Examiner*—Jeffrey Donels
*Assistant Examiner*—Robert W Horn
(74) *Attorney, Agent, or Firm*—Drinker Biddle & Reath LLP

(57) ABSTRACT

The present disclosure relates to a string for a musical instrument comprising duplex stainless steel. The string has high mechanical strength and a high resistance to relaxation. Also, the corrosion resistance is high. Therefore, the string according to the present disclosure has a long service life.

12 Claims, 5 Drawing Sheets

U.S. PATENT DOCUMENTS

| | | | | |
|---|---|---|---|---|
| 5,733,387 | A * | 3/1998 | Lee et al. | 148/325 |
| 6,048,413 | A * | 4/2000 | Park et al. | 148/325 |
| 6,057,498 | A * | 5/2000 | Barney | 84/199 |
| 6,174,386 | B1 * | 1/2001 | Delblanc-Bauer et al. | 148/325 |
| 6,451,133 | B1 * | 9/2002 | Frodigh et al. | 148/325 |
| 6,551,420 | B1 * | 4/2003 | Bergstrom et al. | 148/325 |
| 6,580,021 | B2 * | 6/2003 | Barney | 84/297 S |
| 6,749,697 | B2 * | 6/2004 | Bergstrom et al. | 148/325 |
| 7,560,628 | B2 * | 7/2009 | Yamao et al. | 84/199 |
| 7,589,266 | B2 * | 9/2009 | Richter | 84/297 S |
| 2004/0050463 | A1 * | 3/2004 | Jung et al. | 148/608 |
| 2005/0241454 | A1 * | 11/2005 | Parker | 84/1 |
| 2006/0174745 | A1 * | 8/2006 | D'Addario | 84/297 S |
| 2009/0071313 | A1 * | 3/2009 | Vosough et al. | 84/297 S |
| 2009/0217795 | A1 * | 9/2009 | Vosough et al. | 84/297 S |

FOREIGN PATENT DOCUMENTS

| | | | |
|---|---|---|---|
| JP | 71000935 B | * | 5/1967 |
| WO | 2004/079028 | | 9/2004 |

OTHER PUBLICATIONS

Strings (music) © 2009, viewed Oct. 19, 2009 at www.absoluteastronomy.com/topics/Strings_(music).*

British Steels, re-release of 1960 style stainless steel strings as used by Jimi Hendrix and others. viewed Oct. 14, 2009 at Guitar String Guide.*

Data Sheet for Duplex UNS S31803 provided by Alliance Valves and Piping © 2007, viewed Oct. 14, 2009 at www.aliancevalves.co.uk/super-duplex/duplex-uns-31803.htm.*

Data Sheet for SAF 2507 (UNS S32750), viewed Oct. 15, 2009 at http://www.sandmeyersteel.com/images/2507-Spec-Sheet.pdf.*

Chai, et al. "High and super high strength duplex stainless steels for wire applications," Stainless Steel Works Dec. 2007, viewed Oct. 15, 2009 at http://www.stainless-steel-world.net/pdf/SSW_DEC07_sandvik_LR.pdf.*

Sandvik Springflex™ SH spring wire, S-2115-ENG, Apr. 2005, viewed Oct. 15, 2009 at http://www.smt.sandvik.com/sandvik/0140/internet/S001664.NSF/0/1040F8B4B9501304C12574D4004EB4EA/$file/S-2115-ENG%20Sandvik%20Springflex%20SH%20Product%20Sheet.pdf?OpenElement.*

Tensile strength, Wikipedia, viewed Oct. 15, 2009.*

"Steel Music Wire", Report of the Tests of Metals and Other Materials for Industrial Purposes, United States Testing Machine at Watertown Arsenal, Massachusetts, during the Fiscal Year ended Jun. 30, 1894. Government Printing Office, Washington, D.C. , 1895. http://books.google.com/books?id=dVQOAAAAYAAJ&pg=RA7-PA319#v=onepage&q&f=false Apr. 26, 2010.*

Stainless Steel Mechanical Properties. A to Z Materials © 2000. http://www.azom.com/details.asp?ArticleID=1181 viewed Apr. 26, 2010.*

Swenson, Edward E., Chronologically Arranged Wire Tests © 2008. viewed at http://www.mozartpiano.com/en/articles/wiretests.php Apr. 26, 2010.*

Alvarez-Armas, "Duplex Stainless Steels: Brief History and Some Recent Allows" Recent Patents on Mechanical Engineering, © 2008, Bentham Science Publishers, Ltd., viewed as.*

* cited by examiner

STRING FOR MUSICAL INSTRUMENT

The present invention relates to a string according to the preamble of claim 1.

Such a string is known from inter alia U.S. Pat. No. 4,333,379 comprising a steel core of bronzed gray cast iron.

A musical string, such as a guitar string, needs to possess certain properties. Important properties are the yield strength and tensile strength of the string, i.e. the mechanical strength. The string needs to be able to withstand the required tension when stringed on an instrument and played on. The requirements of mechanical strength are dependant on the diameter of the string. For example, in order for a 0.254 mm (0.010") string to be able to be stringed onto an instrument it needs to have a tensile strength of at least 1500 MPa. Furthermore, in order to be able to withstand being played on by a plectrum the 0.254 mm string should preferably have a tensile strength of approximately 2500 MPa.

Furthermore, another property is the resistance to relaxation. Relaxation resistance is basically how well the guitar string will maintain its tune. For example, a loss of force in the magnitude of 1 N in a string of diameter 0.33 mm corresponds to a drop of 2 Hz in frequency. Since the normal human ear can detect the difference between i.a. 440 Hz and 441 Hz, this means that a force loss of approximately 1 N will give an out of tune frequency of 2 Hz that is well audible for the human ear. If a drop like this occurs, the guitarist must then retune the string to get the desired frequency and tone. The retuning of a string means that the string is stretched further and therefore each time reduced in diameter as a result of the stretching. Hence, frequent retuning leads to a weaker material, inferior sound, reduced esthetic appearance and eventually to a break of the string. Consequently, it is desirable to have a high resistance to relaxation both due to the maintenance of the tune and to the life time of the string.

Another property is the possibility of producing wire to the required dimensions. It shall be possible to cold draw the material of the string down to fine wire diameters without the wire becoming brittle and even breaking. One reason for such brittleness is the formation of strain induced martensite caused by the deformation. Another example of a reason for brittleness is that the material contains intermetallic phases or particles which act as initiation points for cracking when the material is subjected to substantial deformation during wire production. Furthermore, the string may constitute a single wire, one or more twisted wires or a wrapped wire. This in turn renders a need for the material of the wire being sufficiently ductile to be able inter alia to be twisted When in the form or a wire, i.e. in an already substantially deformed state.

In case of a string for electrical instruments, such as an electrical guitar, the sound generated by the string is a result of the electromagnetic properties of the string. Most electric guitars employ electromagnetic pickups, although piezoelectric pickups are also used. The electromagnetic pickup consists of a coil with a permanent magnet. The vibrating strings cause changes in the magnetic flux through the coil, thus inducing electrical signals in the coil. The signals are then transferred to a guitar amplifier where the signal is processed and amplified. The more magnetic a string is, the higher voltage will be produced, hence a louder sound.

Moreover, a string of a musical instrument may be subjected to several different types of corrosion. The corrosion will deteriorate both the mechanical properties and the tuning properties over time. One type of corrosion to which the string is subjected is atmospheric corrosion resulting from the environment in which the instrument is kept or operated. This corrosion may be substantial under for example humid conditions or in warm locations. For example, a musical instrument which is used for outdoor playing may be subjected to substantial atmospheric corrosion over time. Furthermore, when playing a string, substances such as sweat or grease may be transferred from the musician to the string. Such substances may also cause corrosion of the string. Human sweat for example contains sodium chloride which will corrode the string. Also, greasy substances on a string will act as a binding means for other substances, which may corrode the string, thereby forming a covering or film on the surface of the string.

An ordinary guitar string is commonly made of regular high carbon steel alloy drawn to different wire diameters. Carbon steel has many good qualities but also some major drawbacks. It is easy to draw carbon steels to high tensile strengths and yield strengths without encountering brittleness. However, the corrosion properties of carbon steels are not sufficient. Furthermore, strings made of nylon are used in for example modern classical and flamenco guitars. The three highest strings are usually monofilament nylon, while the three lowest strings have nylon cores wrapped with a metal winding. Moreover, flat top or folk guitars use steel wire for the highest two strings and sometimes the third, whereas the remaining strings have steel cores wrapped with carbon steel, nickel-steel, bronze or stainless steel. Usually the wrapping is composed of a fine wire of circular cross section ("round-wound" strings), but sometimes a flat ribbon of stainless steel is used for the wrapping ("flat-wound" strings). Other variations are the "flat-ground" string (wound with round wire that is then ground flat), and compound strings with a winding of silk between the steel core and metal outer windings. As mentioned earlier, the major disadvantage of carbon steel strings is corrosion, and many attempts to arrest corrosion have been done with no success. Ideas of coating the steel strings with different materials such as natural and synthetic polymers have been done. Unfortunately coating generally decreases the strings vibrations leading to reduced brightness and deteriorated sound quality.

Consequently, the object of the invention is to provide a string for a musical instrument with extended life time.

SUMMARY

The stated object is achieved by a string as initially defined and having the features of the characterizing portion of claim 1.

By utilizing a duplex stainless steel in a string for a musical instrument the corrosion properties are substantially improved compared to commonly used materials. Still, the mechanical properties and resistance to relaxation fulfill the requirements, and are even improved compared to commonly used materials. The string can be used both where the sound is generated by vibration only and by vibration causing a change in magnetic field.

The string according to the present disclosure may be used in all kinds of stringed musical instruments, such as guitars, violins, pianos, harps etc.

DETAILED DESCRIPTION

Figure 1:
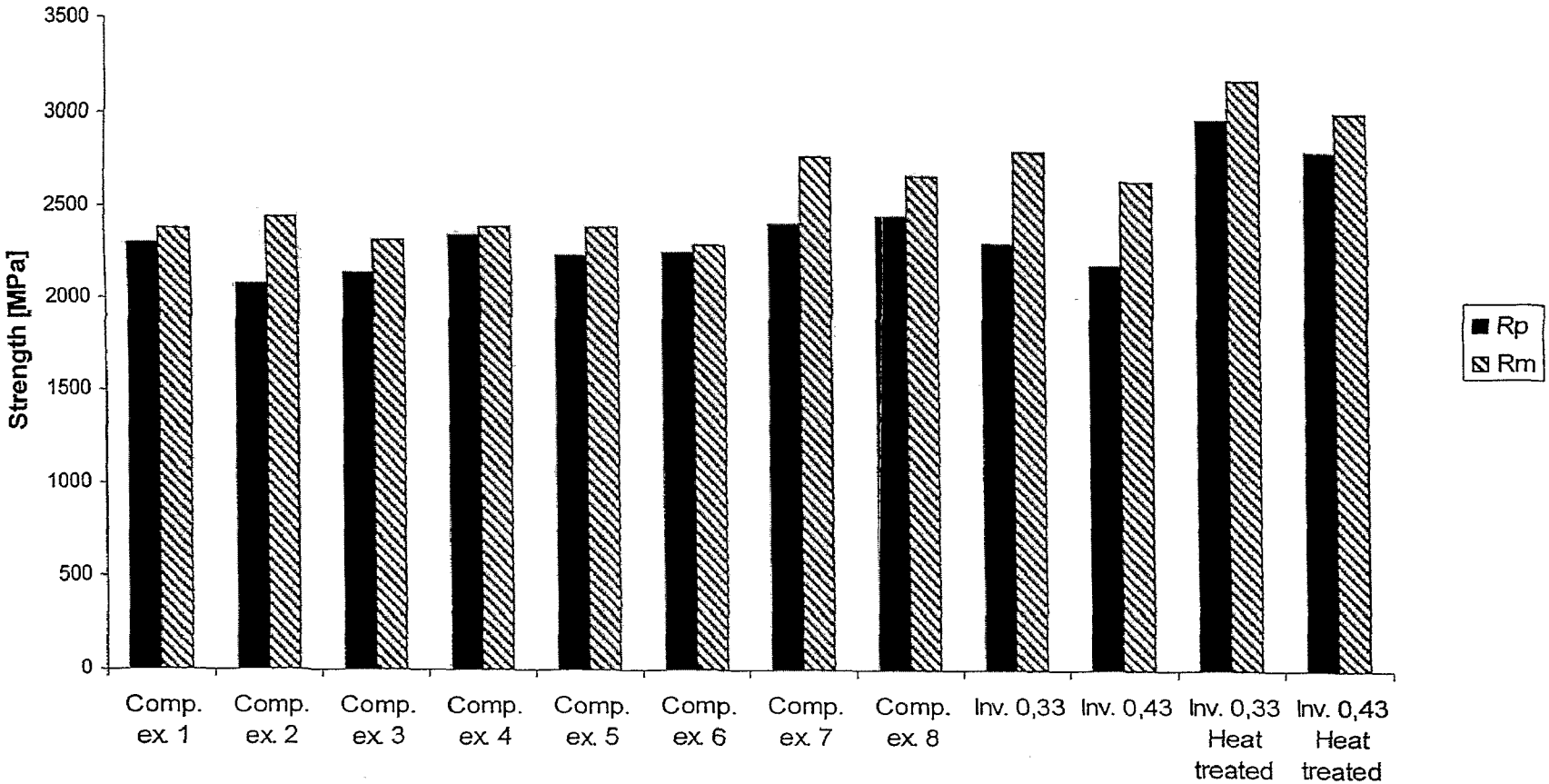
FIG. 1 illustrates the result of tensile test of strings with diameters of 0.33 mm and 0.43 mm according to the invention and eight comparative string compositions.

The different properties which have been proven important for understanding the behavior of a musical string are the yield and tensile strength, the heat treatment, surface finish, corrosion resistance, acoustic sound, resistance to relaxation (tuning stability) and in some cases also the electromagnetic properties.

The importance of the strength, relaxation, corrosion resistance and magnetism has been discussed earlier. The surface finish of the string is important for achieving a harmonic sound and a good feel of the string when played. The acoustic sound is a property which cannot be quantified but is important for how the musician (and possibly the audience) experiences the string. The experience of the acoustic sound of the string according to the present invention is not different from that of commonly used carbon steel strings.

The string according to the present disclosure has a high mechanical strength, such as a tensile strength of at least 2700 MPa when in a diameter of 0.33 mm and cold drawn condition. Furthermore, it has a resistance to relaxation which does not necessitate a retuning more frequently than once every 10 hours when played on under normal conditions.

Moreover, the string according to the present disclosure has excellent resistance to corrosion caused by the environment or substances transferred to the string during its operation. Examples of such substances are sweat or grease transferred from a person playing on the instrument. As a result of this high corrosion resistance, the string does not need to be coated for improved protection.

Duplex stainless steels comprise two separate phases, an austenite phase and a ferrite phase usually in 30-70% of each. The ferrite phase is magnetic whereas the austenite phase is non-magnetic. Since the string according to the present disclosure comprises both phases it also possesses magnetic properties. Moreover, during production of the string, which will be described further below, the austenite phase of the steel will at least partly be transformed to martensite. Since martensite also is a magnetic phase, the magnetism of the string will increase further as the string comprises a higher percentage of magnetic phases after production. Also, if the string should be used in an instrument requiring magnetic properties, such as an electrical guitar, the magnetic properties of the string could be further improved for example by wounding/wrapping or twisting the duplex stainless steel with other metal strands with good magnetic properties or even coated with such a material. Examples of such materials are Ni, Cu and Cu alloys.

Suitable duplex stainless steels to be used in a string generally contain 19-28 percent by weight of Cr and 4-10 percent by weight of Ni, preferably 21-26 wt-% Cr and 4-8 wt-% Ni. A duplex stainless steel in accordance with the present invention could, for example, have the following composition in percent per weight:

| | |
|---|---|
| C | max 0.5 |
| Si | max 1 |
| Mn | max 2 |
| Cr | 20-27 |
| Ni | 4-10 |

-continued

| | |
|---|---|
| Mo + 0.5 W | 0-5 |
| N | max 0.5 |
| Cu | max 0.7 |
| V + Ti | max 0.5 |
| REM + B + Ca | max 0.5 |

balance Fe and normally occurring impurities.

Examples of such stainless steels are UNS S31803, UNS S32304 and UNS S32750. According to a preferred embodiment, the duplex stainless steel is UNS S31803.

An important criteria when selecting among different duplex stainless steels for a string of a musical instrument is the ability to manufacture wires of the material in order to produce the string. It is a pre-requisite that the selected composition can be cold drawn to very fine diameters such as 0.254 mm or 0.33 mm without becoming brittle. It is therefore advisable not to select duplex stainless steels with high risk of forming the brittle sigma phase during manufacturing. Generally, an excessive Mo-content in combination with a high Cr-content means that the risk of forming intermetallic precipitations increases. Also, high contents of N increase the risk of precipitation of chromium nitrides, especially when the content of chromium is also high. It is therefore desirable to not maximise Cr, Mo and N within the ranges given above at the same time.

The string is produced by cold drawing in accordance with conventional processes for wire production. The cold drawing process gives rise to formation of deformation induced martensite which leads to increased mechanical strength and a more magnetic material. The amount of cold deformation is important for achieving the desired strength and magnetic properties. The string can also be heat treated after the deformation into the desired dimension. The heat treatment may further improve the properties of the material. Also, if the deformation results in a too brittle material, it may be subjected to a heat treatment in order to reduce the introduced strain and thereby increase the ductility of the material. These heat treatment processes are commonly known to a person skilled in the art of duplex stainless steels.

The manufacturing processes for producing wires of duplex stainless steel results in strings of good surface finish. This means that the musician experiences a string which is comfortable to play on. Furthermore, there is no risk of the string experiencing deteriorated properties such as inharmonicity.

Pitting corrosion is a type of localized corrosion attack of a material. It can for example be caused by chloride ions, which may in the case of musical strings come into contact with the material from human sweat from the musician. The resistance to pitting corrosion can be expressed with the Critical Pitting Temperature (CPT) which indicates the maximum temperature to which the material can be subjected without risk of pitting corrosion attacks occurring.

Furthermore, the pitting corrosion resistance of a stainless steel is often expressed as the theoretical PRE-value (Pitting Resistance Equivalent) and is given by Equation 1.

$$\text{PRE: \% Cr+\% 3.3\% Mo+0.16\% N} \qquad \text{Equation 1}$$

This means that increasing the Cr, Mo and/or N content of the stainless steel improves the corrosion resistance.

According to an embodiment, the string is provided with a surface layer. This surface layer may for example have an esthetic function or a tuning function, for example for increased magnetism.

According to another embodiment, the string comprises a core wrapped with metal strands. In this embodiment, at least the core is made of duplex stainless steel.

The string according to the present disclosure may be used in all kinds of stringed musical instruments, such as guitars, violins, pianos, harps etc. The string may be a single wire, but it may also be in the form of a wrapped or wounded string. The string may also be twisted.

Example 1

Test wires were produced of a duplex stainless steel with the following composition (all in percent by weight):

0.03% C
0.4% Si
1.5% Mn
22% Cr
5.2% Ni
3.2% Mo
0.17% N
balance Fe and normally occurring impurities.

This alloy is standardized under US-standard AISI UNS S31803.

Wires were cold drawn to diameters of 0.254 mm, 0.33 mm and 0.43 mm, respectively. One of the wires of each diameter was after drawing heat treated at a temperature of 475° C. for approximately 10 minutes resulting in an increased strength and higher resistance to relaxation of the material.

The yield and tensile strengths were measured by a tensile test in accordance with SS-EN10002-1 and compared to 8 different comparative examples of strings of carbon steels. The approximate compositions of the comparative examples are shown in Table 1, as well as the string diameter of the comparative examples.

The result of the yield ($Rp_{0.2}$) and tensile (Rm) test is listed in Table 2 and illustrated in FIG. 1. From these test it is evident that the change of material to a duplex stainless steel does not substantially reduce the mechanical strength of the string. It is even possible to improve the strength, especially in the case of the duplex stainless steel being heat treated after drawing.

TABLE 1

| Comparative sample no. | Fe | Si | Mn | Diameter of string [mm] |
|---|---|---|---|---|
| 1 | 99.2 | 0.2 | 0.7 | 0.43 |
| 2 | 98.9 | 0.3 | 0.7 | 0.43 |
| 3 | 99.3 | 0.2 | 0.5 | 0.43 |
| 4 | 99.2 | 0.2 | 0.7 | 0.43 |
| 5 | 99.3 | 0.2 | 0.5 | 0.43 |
| 6 | 99.1 | 0.2 | 0.7 | 0.43 |
| 7 | 99.3 | 0.3 | 0.5 | 0.43 |
| 8 | 99.2 | 0.2 | 0.6 | 0.33 |

TABLE 2

| Sample | $Rp_{0.2}$ [MPa] | Rm [MPa] |
|---|---|---|
| Comp. ex. 1 | 2307 | 2384 |
| Comp. ex. 2 | 2076 | 2446 |
| Comp. ex. 3 | 2140 | 2322 |
| Comp. ex. 4 | 2348 | 2392 |
| Comp. ex. 5 | 2239 | 2394 |
| Comp. ex. 6 | 2251 | 2300 |
| Comp. ex. 7 | 2408 | 2772 |
| Comp. ex. 8 | 2455 | 2665 |
| Inv. 0.33 cold drawn | 2305 | 2795 |

TABLE 2-continued

| Sample | $Rp_{0.2}$ [MPa] | Rm [MPa] |
|---|---|---|
| Inv. 0.43 cold drawn | 2183 | 2644 |
| Inv. 0.33 heat treated | 2969 | 3178 |
| Inv. 0.43 heat treated | 2801 | 3007 |

Example 2

The relaxation resistance was tested by plucking 0.33 mm diameter and 0.43 diameter strings approximately 200 times per minute with a pick. The compositions are those of example 1. The test was performed over 24 hours. The plucking point of the pick was set at 18 cm from a force sensor connected to a computer. The total length of each string was 65 cm and the strings rested on two plastic pieces at each end point. The distance between each end point and the force sensors was 5 cm. The diameter and its corresponding tone frequency are given in Table 3 along with the original tension and the engineering stress of the strings.

TABLE 3

| Diameter [mm] | Tone frequency [Hz] | Tension [N] | Engineering stress [MPa] |
|---|---|---|---|
| 0.33 | 247 | 68.5 | 801 |
| 0.43 | 196 | 73.9 | 509 |

Figure 2:
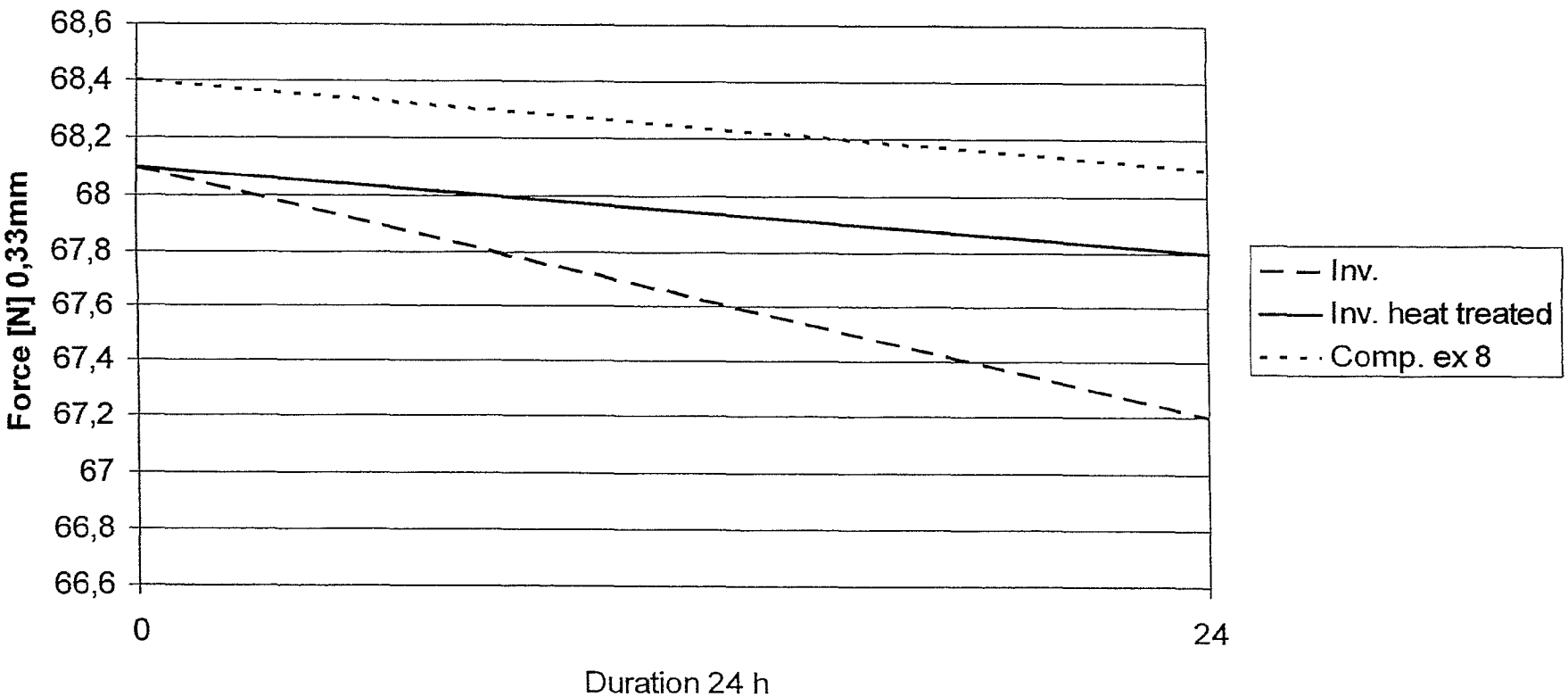
FIG. 2 illustrates the result of a relaxation test of strings with diameter of 0.33 mm according to the invention and a comparative string.
Figure 3:
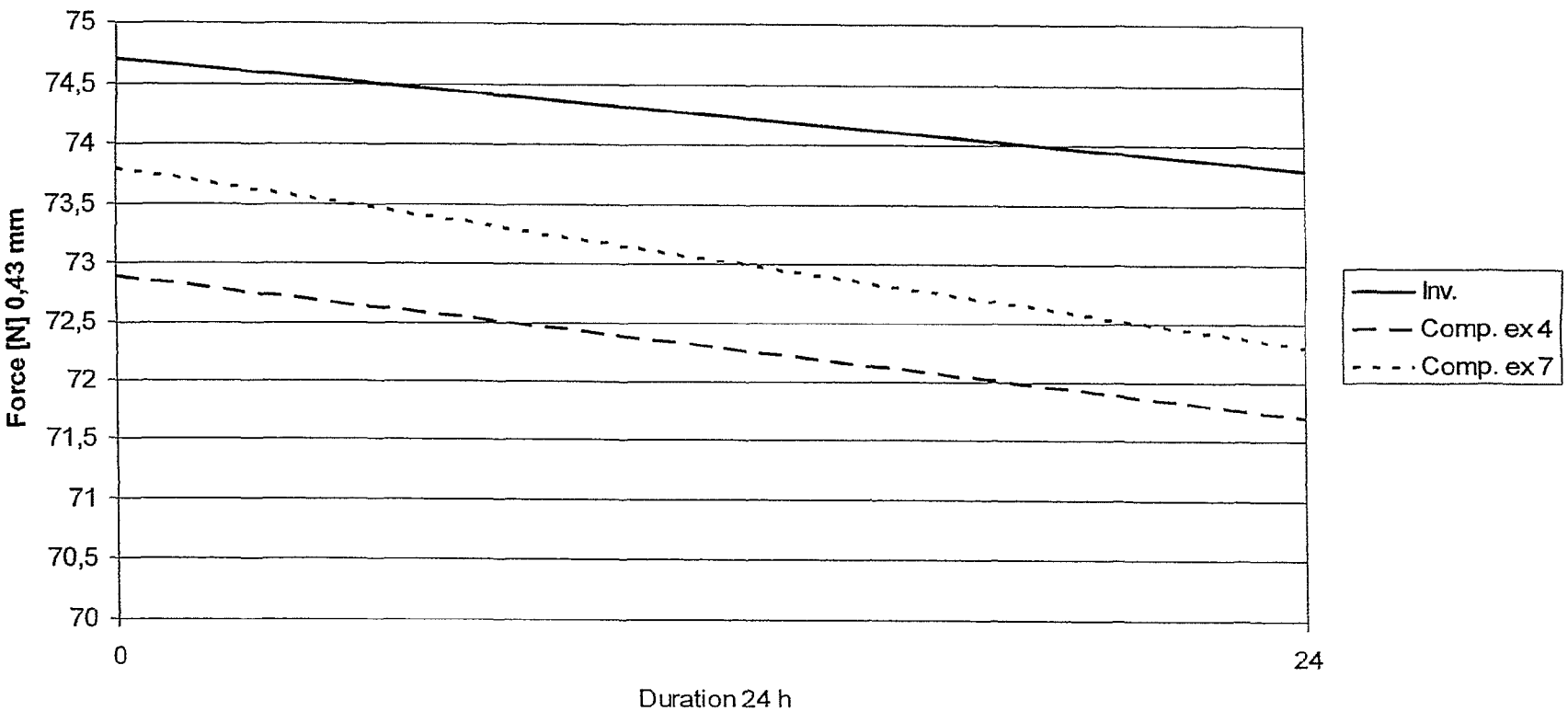
FIG. 3 illustrates the result of a relaxation test of string with diameter of 0.43 mm according to the invention and comparative strings.

The result of the relaxation test of strings with diameter 0.33 mm is illustrated in FIG. 2 and the results of the relaxation test of strings with diameter of 0.43 is illustrated in FIG. 3. The results are listed in Table 4 in the form of the linear Equation 2 wherein y is the force, k is a constant, x is time in hours and m is a constant.

$$y=k*x+m \qquad \text{Equation 2}$$

The smaller k-value/slope the linear equation for each string has, the better is the relaxation property. The results show that the duplex stainless steels in cold drawn condition have the same relaxation properties as the carbon steels used today for the guitar string application. But when heat treated the relaxation property is remarkably increased.

TABLE 4

| Sample | Start tension [N] | Tension after 24 h [N] | Frequency loss [Hz] | k-value |
|---|---|---|---|---|
| Comp. ex. 3 0.33 | 68.4 | 68.1 | 0.54 | y = −0.0125x + 68.4 |
| Comp. ex. 4 | 72.9 | 71.7 | 1.62 | y = −0.05x + 72.9 |
| Comp. ex. 7 | 73.8 | 72.3 | 2.02 | y = −0.0625x + 73.8 |
| Comp. ex. 8 | 68.4 | 68.1 | 0.42 | y = −0.0125x + 68.4 |
| Inv. 0.33 cold drawn | 68.1 | 67.2 | 1.62 | y = −0.0375x + 68.1 |
| Inv. 0.43 cold drawn | 74.7 | 73.8 | 1.20 | y = −0.0375x + 74.7 |
| Inv. 0.33 heat treated | 68.1 | 67.8 | 1.09 | y = −0.0125x + 68.1 |

The human ear can detect a change in tune frequency of 1 Hz. The string of Comparative Example 7 had lost 1.5 N (corresponding to a frequency lost of approximately 2 Hz) after 24 hours which means that a musician must retune a string of Comparative Example 7 once every 12 hours. This can be compared to the invention when in a diameter of 0.43 mm and In cold drawn condition lost 0.9 N corresponding to a frequency lost of approximately 1.2 Hz resulting in a need for retuning once every 20 hours. This results in a much longer service life of the string according to the invention compared to Comparative Example 7.

Example 4

Figure 4:
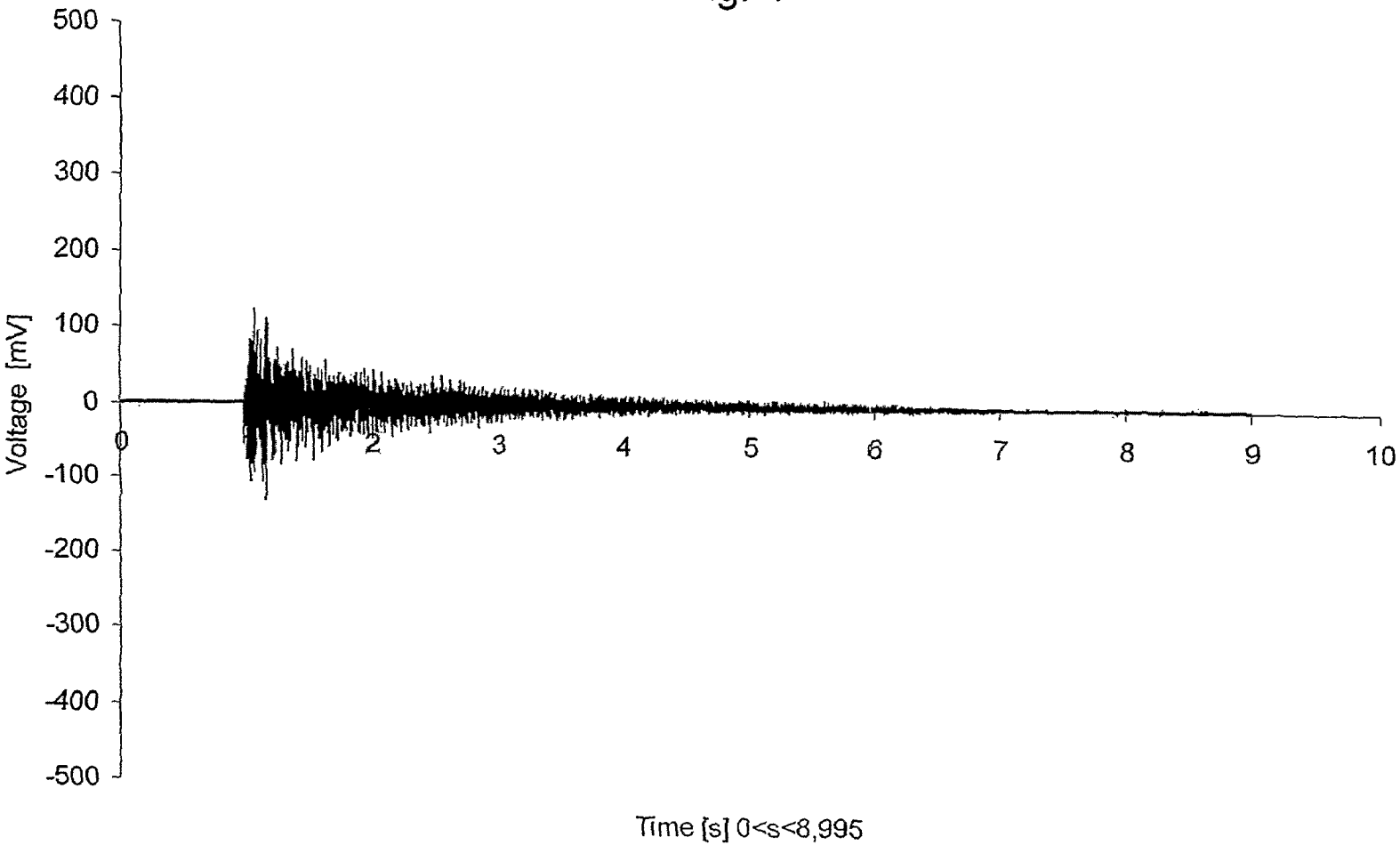
FIG. 4 illustrates the result of a magnetic resonance test of a string in accordance with the present invention.
Figure 5:
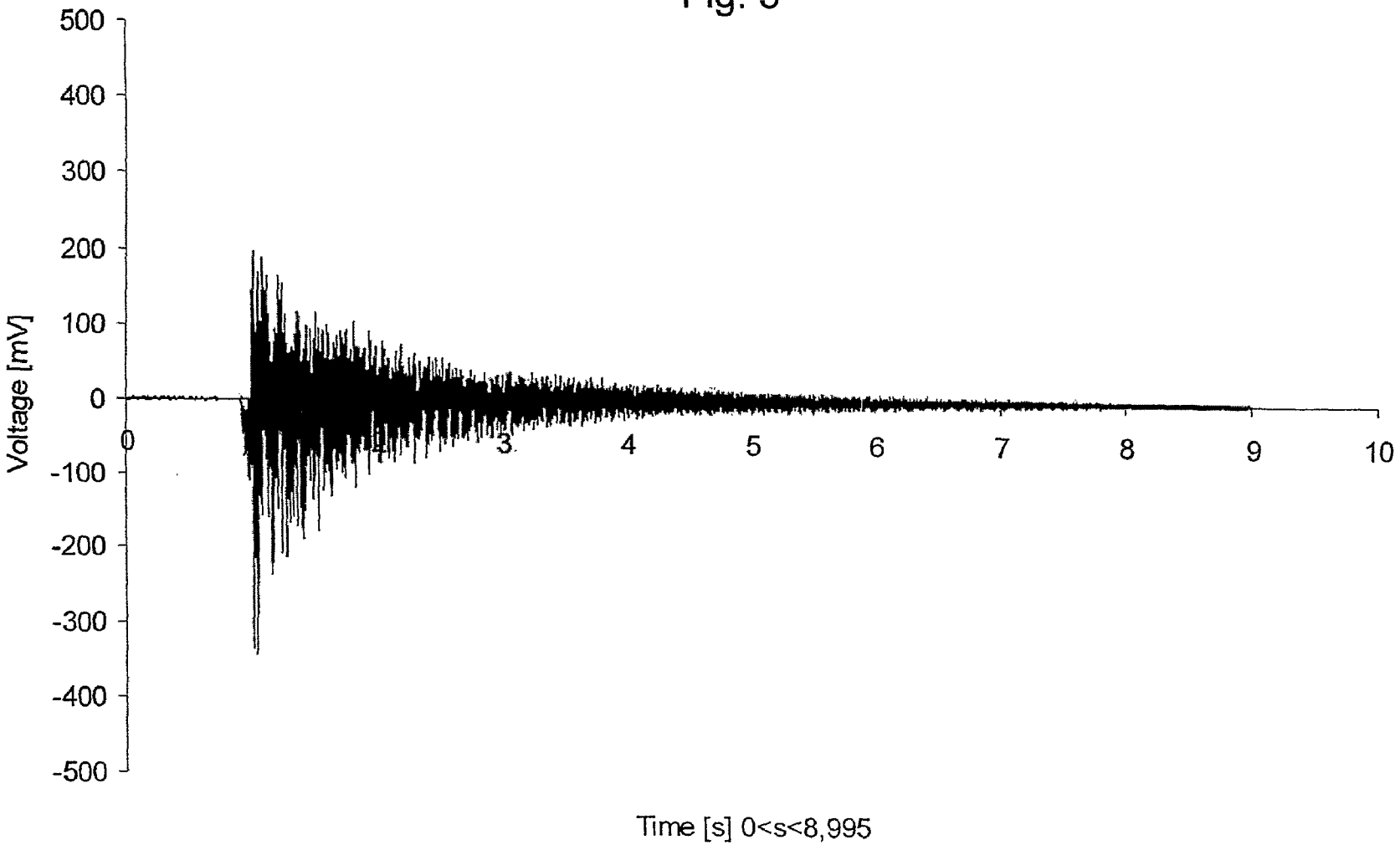
FIG. 5 illustrates the result of a magnetic resonance test of a string of a comparative example.

The magnetic resonance of the alloy of Example 1 was tested on a guitar and compared to that of Comparative Example 6. The strings were plucked at a distance of 10 cm from the bridge and subjected to a force corresponding to the shear-breaking point of a 0.10 mm copper wire. The copper wire was looped around perpendicular to the plucked string and then pulled until breaking point. In this way the same force was applied for every test run. The breaking point of the copper wire must also be at the point of contact with the plucked string, if the copper wire broke at any other point the procedure was repeated. A series of five approved tests were done on each string. The data from these five tests were then gathered and graphs from each test series is presented in FIGS. 4 and 5.

Furthermore the magnetic weight of the material was tested and compared to Comparative example 4. To measure the amount of magnetic and non-magnetic phase, a magnetic balance was used. The magnetic balance contains two major components, an electromagnet and a strain gauge. The electromagnet generates a strong inhomogenic magnetic field between two wedge-shaped poles wherein the test sample in situated. If there are some magnetic phases present in the sample it will be pulled down by the magnetic force. The force, which is proportional to the amount of magnetic phase, is then measured by the strain gauge. This measurement yields the saturation magnetisation of the sample and by calculating the theoretical saturation magnetisation for this steel it is possible to determine the amount of magnetic phase present in the sample, i.e. the magnetic weight. The values from the magnetic weight test are illustrated in Table 5.

It is evident that the alloy according to the present invention has a much lower magnetism than commonly used carbon steel wires illustrated by the comparative example. This indicates that a string of a duplex stainless steel in accordance with the present invention would in optional embodiments benefit from being wrapped or twisted with an additional wire of a material with higher magnetism when intended for use in applications requiring high magnetism such as electrical guitars.

TABLE 5

| Sample | Length [mm] | Weight [g] | $\sigma_s$ [gauss*cm$^3$/g] |
|---|---|---|---|
| Invention 0.43 mm | 0.70 | 0.423 | 94.2 |
| Comparative example 4 | 0.57 | 0.164 | 193.8 |

Example 5

The corrosion properties of the alloy of Example 1 were previously known and therefore not tested. The composition in accordance with the present example has a superior resistance to corrosion. This may be illustrated by the Critical Pitting Temperature (CPT) which is approximately 82° C. for the duplex stainless steel of Example 1 when tested in a 0.5% $Cl^-$ solution with pH 6.0 and 300 mV SCE (Standard Calomel Electrode). This indicates that the material is resistant to pitting corrosion resulting from for example chloride ions present in human sweat up to a temperature of 82° C. This could for example be compared to a CPT of 25° C. for the stainless steel AISI 304, which could make the latter steel much less suitable when exposed to sweat in environments with higher temperatures than room temperature.

Moreover, for reference UNS S32304 has a CPT value of 32° C. and UNS S32750 has a CPT value of >100° C. (not tested above this value) when tested under the same conditions.

The invention claimed is:

1. String for musical instrument comprising a duplex stainless steel, wherein the duplex stainless steel has a composition, all in percent by weight, of:

| | |
|---|---|
| C | max 0.5 |
| Si | max 1 |
| Mn | max 2 |
| Cr | 20-27 |
| Ni | 4-10 |
| Mo + 0.5 W | 0-5 |
| N | max 0.5 |
| Cu | max 0.7 |
| V + Ti | max 0.5 |
| REM + B + Ca | max 0.5 |

balance Fe and normally occurring impurities.

2. String according to claim 1 wherein the duplex stainless steel comprises 19-28 percent by weight of Cr and 4-10 percent by weight of Ni.

3. String according to claim 1 wherein the duplex stainless steel is UNS S31803.

4. String according to claim 2 wherein the duplex stainless steel is UNS S32750.

5. String according to claim 2 wherein the duplex stainless steel is UNS 832304.

6. String according to claim 1 wherein the string has a tensile strength of at least 2700 MPa when in a diameter of 0.33 mm.

7. String according to claim 1 wherein the string has a resistance to relaxation such as it will resist a loss of frequency of 2 Hz for at least 10 hours.

8. String according to claim 1 wherein the duplex stainless steel is in cold drawn condition.

9. String according to claim 1 wherein the duplex stainless steel is in heat treated condition.

10. String according to claim 1 comprising a core of duplex stainless steel wrapped with metal strands.

11. String according to claim 1 wherein the string is provided with a surface layer.

12. Musical instrument comprising a string according to claim 1.

* * * * *